US011965696B2

(12) United States Patent
Tournois et al.

(10) Patent No.: US 11,965,696 B2
(45) Date of Patent: Apr. 23, 2024

(54) HEAT EXCHANGER WITH BRAZED END FLANGE

(71) Applicant: Valeo Systemes Thermiques, Le Mesnil Saint Denis (FR)

(72) Inventors: Rémi Tournois, Le Mesnil Saint Denis (FR); Yves Seynat, Reims (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 246 days.

(21) Appl. No.: 17/414,850

(22) PCT Filed: Dec. 19, 2019

(86) PCT No.: PCT/FR2019/053198
§ 371 (c)(1),
(2) Date: Jun. 16, 2021

(87) PCT Pub. No.: WO2020/128360
PCT Pub. Date: Jun. 25, 2020

(65) Prior Publication Data

US 2022/0018604 A1 Jan. 20, 2022

(30) Foreign Application Priority Data

Dec. 19, 2018 (FR) ..... 1873426

(51) Int. Cl.
*F28D 1/04* (2006.01)
*F28D 1/053* (2006.01)
*F28F 9/013* (2006.01)

(52) U.S. Cl.
CPC ..... *F28D 1/0435* (2013.01); *F28D 1/05316* (2013.01); *F28F 9/013* (2013.01);
(Continued)

(58) Field of Classification Search
CPC .. F28F 2275/085; F28F 2275/04; F28F 9/013; F28D 1/05316
See application file for complete search history.

(56) References Cited

U.S. PATENT DOCUMENTS 5,366,007 A * 11/1994 Hutto ..... F28F 9/0246 165/173
10,516,192 B2 * 12/2019 Prevost ..... B60L 58/21
(Continued)

FOREIGN PATENT DOCUMENTS

DE 102005004521 A1 * 8/2005 ..... F28D 1/0435
EP 1120620 A1 * 8/2001 ..... F28D 1/0435
(Continued)

OTHER PUBLICATIONS

International Search Report and Written Opinion issued in corresponding International Application No. PCT/FR2019/053198, dated May 29, 2020 (10 pages).

*Primary Examiner* — Paul Alvare
(74) *Attorney, Agent, or Firm* — Osha Bergman Watanabe & Burton LLP

(57) ABSTRACT

A heat exchanger for a motor vehicle includes heat exchange bundle with a plurality of stacked tubes inside which a first heat-transfer fluid circulates, and an end flange arranged on each side of the stack of tubes which brazed to the heat exchange bundle. The end flanges include a flat body with a first surface that faces an aerodynamic element and a second surface, the brazing surface, opposite to the first surface and brazed to the heat exchange bundle. Attachment tabs receive the aerodynamic element and are arranged on the sides of the flat body, the attachment tabs projecting in the opposite direction to the heat exchange bundle. At least one extension of the flat body extends in the same general plane as the flat body and is arranged between a pair of attachment tabs on a same side of the flat body.

7 Claims, 6 Drawing Sheets

Figure 1:
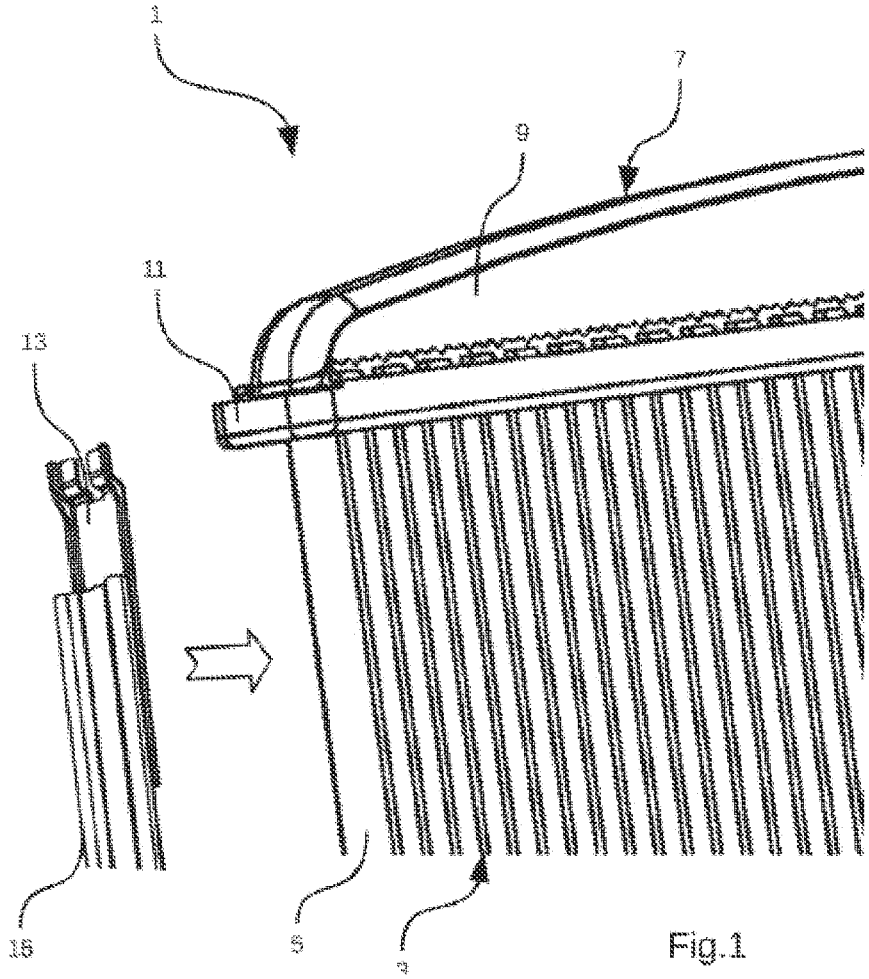

(52) U.S. Cl.
CPC ..... *F28F 2255/08* (2013.01); *F28F 2275/04* (2013.01); *F28F 2275/085* (2013.01)

(56) References Cited

U.S. PATENT DOCUMENTS

| | | | | |
|---|---|---|---|---|
| 11,255,617 | B2 * | 2/2022 | Nguyen | F28D 1/0435 |
| 2001/0040021 | A1 * | 11/2001 | Avequin | F28F 9/0131 29/890.03 |
| 2001/0047860 | A1 * | 12/2001 | Martins | F28F 1/32 165/149 |
| 2003/0230397 | A1 * | 12/2003 | Southwick | F28F 9/002 180/68.4 |
| 2004/0031598 | A1 * | 2/2004 | Shimanuki | F28F 1/022 165/164 |
| 2005/0224219 | A1 * | 10/2005 | Reier | F28D 1/05366 165/149 |
| 2006/0070725 | A1 * | 4/2006 | Kroetsch | F28F 9/001 165/149 |
| 2008/0230213 | A1 * | 9/2008 | Roll | B21D 53/08 165/173 |
| 2010/0089558 | A1 * | 4/2010 | Takada | F24F 12/006 165/185 |
| 2015/0068501 | A1 * | 3/2015 | Ferlay | F02B 29/0475 123/542 |
| 2020/0064084 | A1 * | 2/2020 | Tian | F28F 9/0224 |
| 2020/0217600 | A1 * | 7/2020 | Sus | F28F 9/001 |

FOREIGN PATENT DOCUMENTS

| | | | | |
|---|---|---|---|---|
| EP | 1176379 | A1 * | 1/2002 | F28D 1/0435 |
| EP | 2450658 | A1 * | 5/2012 | F28F 21/067 |
| FR | 2849174 | A1 | 6/2004 | |
| FR | 2868522 | A1 | 10/2005 | |
| FR | 2880679 | A1 | 7/2006 | |
| FR | 3056736 | A1 | 3/2018 | |
| IT | 1155918 | B * | 1/1987 | F28F 9/0202 |

* cited by examiner

HEAT EXCHANGER WITH BRAZED END FLANGE

The invention relates to the field of heat exchangers and more specifically to heat exchangers having a bundle of tubes and comprising end flanges.

Heat exchangers, for example air/heat-transfer fluid exchangers, generally include a heat exchange bundle comprising a plurality of stacked tubes. At the ends of the heat exchange bundle is arranged a manifold inside which the heat-transfer fluid is intended to circulate so that it circulates within the tubes. The air circulates between the tubes.

On either side of the stack of tubes of the heat exchange bundle, the heat exchanger generally comprises end flanges brazed to the heat exchange bundle. These end flanges allow in particular the attachment of an aerodynamic element such as a deflector or a seal in order to block or deflect the circulation of air on the sides of the heat exchanger. In order to attach this aerodynamic element, the edges of the end flange are raised to form a rim with which the aerodynamic element engages.

However, the fact that the edges of the end flange are raised may result in a decrease in the surface area for contact between said end flange and the heat exchange bundle. Consequently, the useful surface area for brazing between the end flange and the heat exchange bundle is also reduced and this can lead to end flange attachment defects. This is particularly the case with thin heat exchangers, for example having a thickness between 12 and 18 mm.

One of the aims of the present invention is to at least partially overcome the drawbacks of the prior art and to provide a heat exchanger with improved attachment of the end flanges.

The present invention therefore relates to a heat exchanger, in particular for a motor vehicle, comprising:

- a heat exchange bundle comprising a plurality of stacked tubes inside which a first heat-transfer fluid is intended to circulate, and
- an end flange arranged on each side of the stack of tubes, said end flange being brazed to the heat exchange bundle, the end flanges comprising:
- a flat body comprising a first surface intended to face an aerodynamic element and a second surface, referred to as the brazing surface, opposite to the first surface and brazed to the heat exchange bundle,
- attachment tabs configured to receive the aerodynamic element and arranged on the sides of said flat body, said attachment tabs projecting in the opposite direction to the heat exchange bundle,
- at least one extension of the flat body extending in the same general plane as said flat body and arranged between a pair of attachment tabs arranged on a same side of said flat body, such that the width of the flat body between said pair of attachment tabs and an attachment tab arranged on the opposite side of said flat body, facing the pair of attachment tabs, is less than the width of the flat body at the at least one extension.

This difference in width makes it possible to increase the general surface area of the flat body and in particular its second surface. Thus, the useful surface area for attaching the end flange to the heat exchange bundle is enlarged and allows better attachment. This is particularly useful in the case of thin heat exchangers which have a width of between 12 and 18 mm, for example.

According to one aspect of the invention, an extension is arranged between each pair of attachment tabs arranged along the sides of said flat body.

According to another aspect of the invention, the attachment tabs on a first side of the flat body are arranged facing the attachment tabs on a second side opposite to the first side, and that the extensions on the first side of the flat body are arranged facing the extensions on the second side.

According to another aspect of the invention, the attachment tabs on a first side are arranged facing the extensions on a second side opposite to the first side, and that the extensions on the first side are arranged facing the attachment tabs on the second side.

According to another aspect of the invention, the attachment tabs have at their top a hooking rim configured to retain the aerodynamic element.

According to another aspect of the invention, the attachment tabs on a same side are connected at their top by the hooking rim.

According to another aspect of the invention, the attachment tabs and the extensions of the flat body are integral with said flat body.

According to another aspect of the invention, the attachment tabs and the extensions of the flat body are produced by stamping.

Figure 2A:
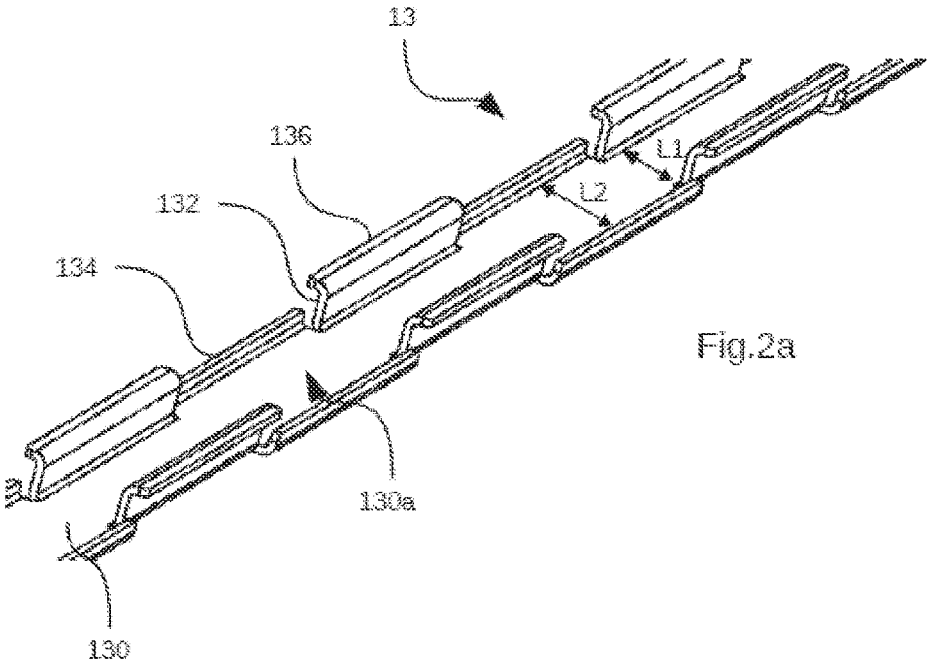
Figure 2B:
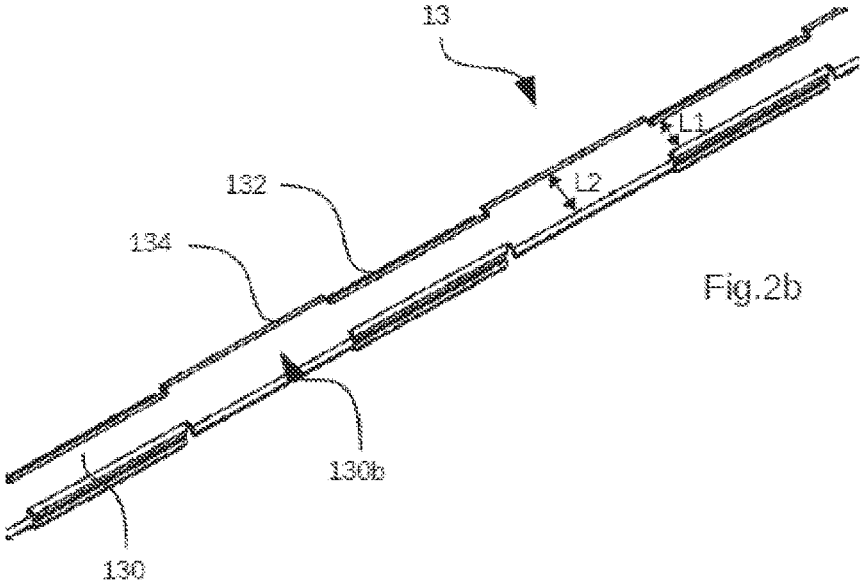
Figure 3A:
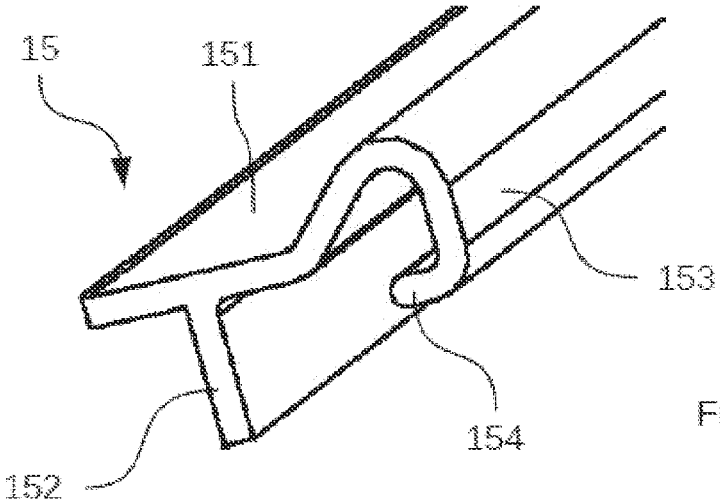
Figure 3B:
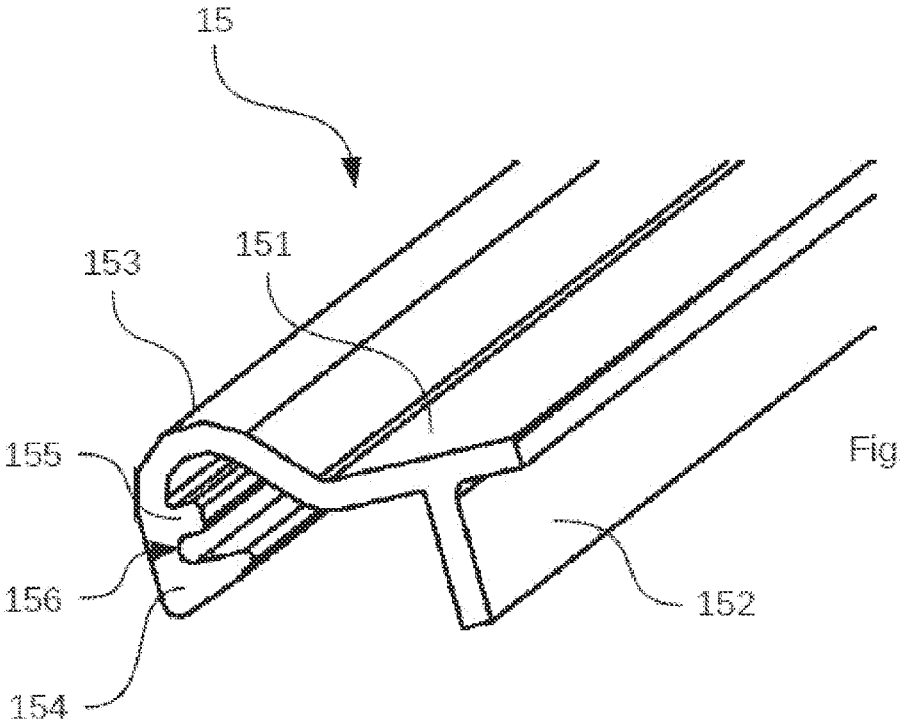
Figure 4A:
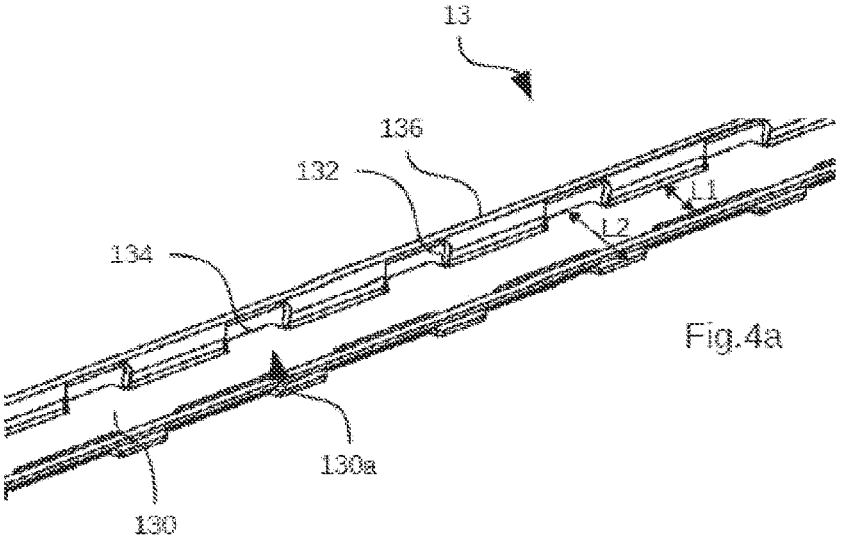
Figure 4B:
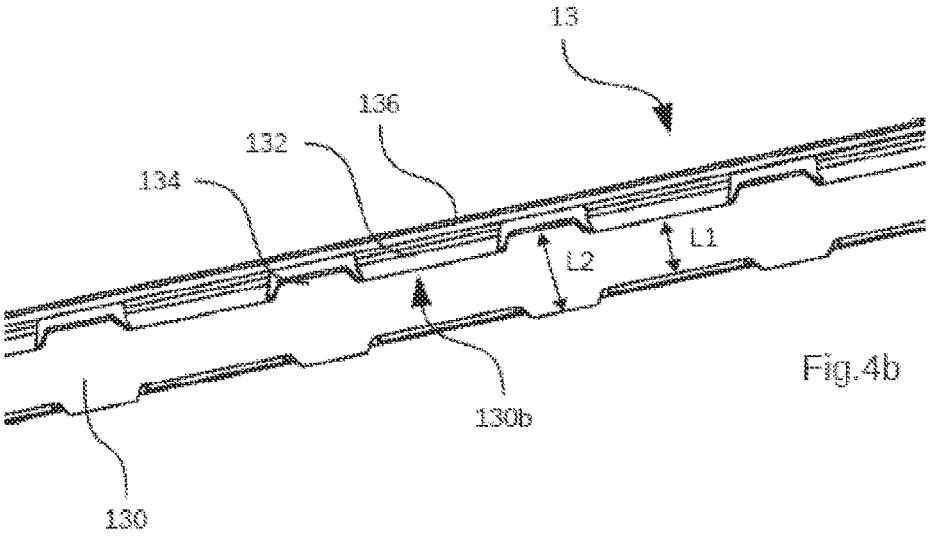
Figure 5A:
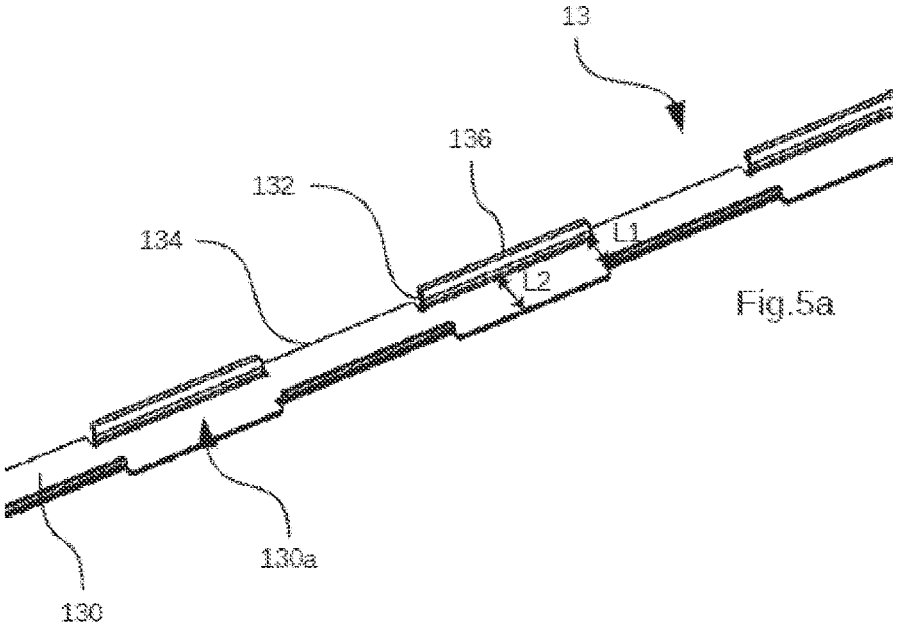
Figure 5B:
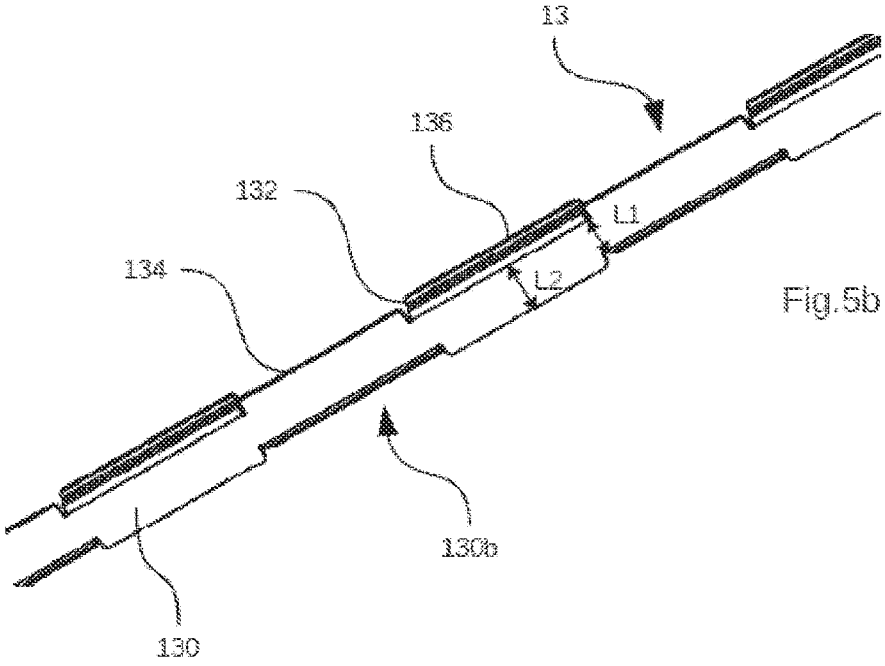
Figure 6A:
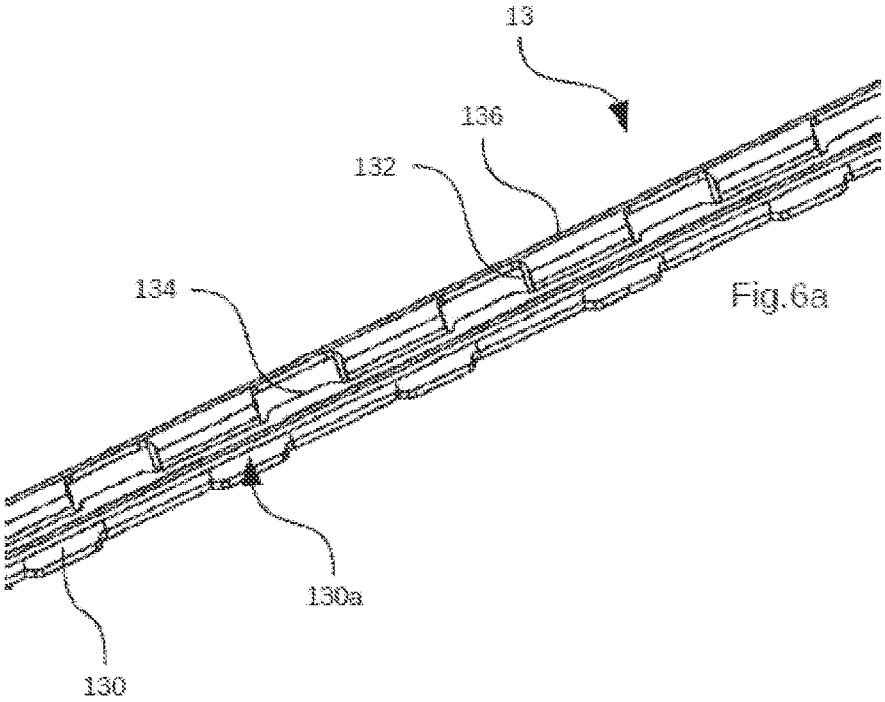
Figure 6B:
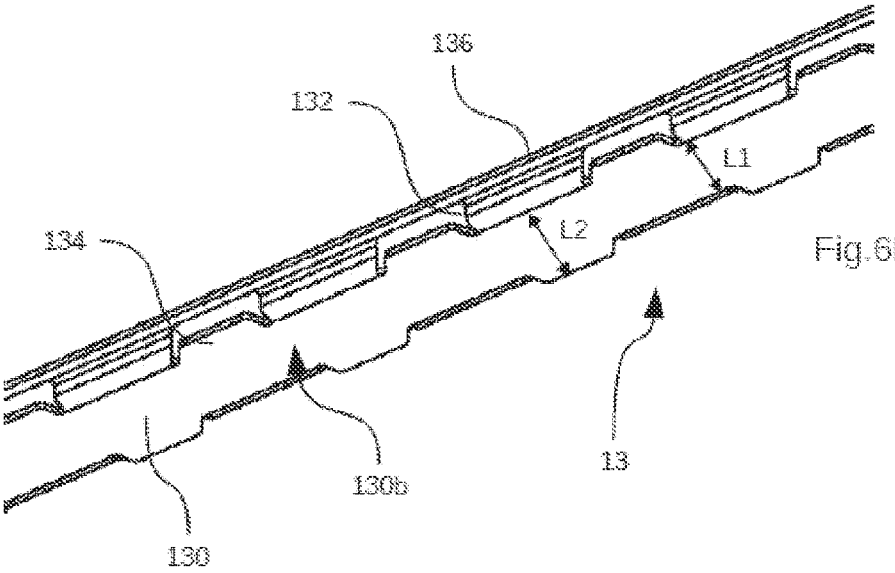

Further features and advantages of the invention will emerge more clearly on reading the following description, provided by way of illustrative and non-limiting example, and the appended drawings, in which:

FIG. 1 shows a schematic perspective view of a heat exchanger,

FIG. 2*a* shows a schematic perspective view of a front face of an end flange according to a first embodiment, FIG. 2*b* shows a schematic perspective view of a rear face of an end flange according to the first embodiment, FIG. 3*a* shows a schematic perspective sectional view of an aerodynamic element according to a first variant, FIG. 3*b* shows a schematic perspective sectional view of an aerodynamic element according to a second variant, FIG. 4*a* shows a schematic perspective view of a front face of an end flange according to a variant of the first embodiment, FIG. 4*b* shows a schematic perspective view of a rear face of an end flange according to the variant of the first embodiment, FIG. 5*a* shows a schematic perspective view of a front face of an end flange according to a second embodiment, FIG. 5*b* shows a schematic perspective view of a rear face of an end flange according to the second embodiment, FIG. 6*a* shows a schematic perspective view of a front face of an end flange according to a variant of the second embodiment, FIG. 6*b* shows a schematic perspective view of a rear face of an end flange according to the variant of the second embodiment.

In the various figures, identical elements bear the same reference numbers.

The following embodiments are examples. Although the description refers to one or more embodiments, this does not necessarily mean that each reference relates to the same embodiment, or that the features apply only to a single embodiment. Individual features of different embodiments can also be combined and/or interchanged to provide other embodiments.

In the present description, certain elements or parameters may be designated as first element or second element, for example, or first parameter and second parameter or first criterion and second criterion, etc. In this case, it is simply a designation to differentiate between and name elements or parameters or criteria that are similar but not identical. Such designation does not imply that one element, parameter or criterion has priority over another and such names can easily be interchanged without departing from the scope of the present description. Such designation also does not imply any chronological order, for example in assessing any given criterion.

FIG. 1 shows a partial semi-exploded view of a heat exchanger 1. The heat exchanger 1 includes a heat exchange bundle 3 comprising a plurality of stacked tubes 5 and a manifold 7. A manifold 7 is arranged at each end of the heat exchange bundle 3. A heat-transfer fluid is intended to circulate within the heat exchanger 1, more particularly in the manifolds 7 which redistribute the heat-transfer fluid in the tubes 5. The manifold 7 comprises a manifold plate 11 through which the tubes 5 pass. The connection between the manifold plate 11 and the tubes 5 is sealed. This sealed connection can be achieved by brazing in the case of a heat exchanger referred to as brazed, or by means of one or more seals in the case of a mechanical or mechanical/brazed heat exchanger. The manifold plate 11 is covered by a cap 9 so as to form a free volume inside which the heat-transfer fluid circulates in order to be redistributed within the various tubes 5. This cap 9 has an inlet and/or outlet for heat-transfer fluid (not visible).

Between the tubes 5 are arranged interfering elements (not shown), for example fins, for disturbing the flow of the second heat-transfer fluid, for example air, intended to circulate between said tubes 5.

On each side of the stack of tubes 5, there is an end flange 13. This end flange 13 is made of metal, preferably the same metal as the tubes 5 or the interfering elements. The end flange 13 is brazed to the heat exchange bundle 3. It may be brazed directly to a tube 5 or to a disturbing element placed on the side of the stack of tubes 5. This end flange 13 is configured to allow the attachment of an aerodynamic element 15, for example a deflector, or a seal in order to block or deflect the circulation of the second heat-transfer fluid on the sides of the heat exchanger 1.

FIGS. 2*a* and 2*b* show the structure of an end flange 13 in more detail. This end flange 13 includes a flat body 130 comprising a first surface 130*a* (visible in FIG. 2*a*) intended to be placed facing an aerodynamic element 15, and a second surface 130*b* (visible in FIG. 2*b*), referred to as the brazing surface, opposite to the first surface 130*a* and brazed to the heat exchange bundle 3. The end flange 13 has a total width substantially equal to that of the heat exchanger 1 and more particularly that of its heat exchange bundle 3, so that no element of the end flange 13 protrudes widthwise, in order to limit the size of the heat exchanger 1.

The end flange 13 also has attachment tabs 132 configured to receive the aerodynamic element 15. These attachment tabs 132 are arranged on the sides of said flat body 130 and project in the opposite direction to the heat exchange bundle 3.

These attachment tabs 132 may in particular include, at their top, a hooking rim 136 configured to retain the aerodynamic element 15. This hooking rim 136 may in particular constitute a recess in the attachment tab 132 on which is hooked a hooked rim 154 (visible in FIGS. 3*a* and 3*b*) of the aerodynamic element 15.

The attachment tabs 132 may in particular be integral with the flat body 130. The attachment tabs 132 may thus be produced by stamping. The hooking rim 136 must be contained within the total width of the end flange 13 and thus, in the area of the attachment tabs 132, the width of the flat body 130 and therefore the second surface 130*b* is reduced accordingly.

FIGS. 3*a* and 3*b* show in more detail the structure of two halves of an aerodynamic element 15, in particular the hooked rim 154 thereof. The aerodynamic element 15 in this case comprises a surface 151 and, on either side of this surface 151, a bent portion 153 bent toward the inside of the surface 151 (in FIGS. 3*a* and 3*b*, only one bent portion 153 is shown instead of two). This bent portion 153 thus forms the hooked rim 154 which hooks onto the hooking rim 136 of the end flange 13.

The aerodynamic element 15 may also include a leg 152 intended to bear on the first surface 130*a* of the end flange 13. The aerodynamic element 15 may be made of plastic or elastomer. The aerodynamic element 15 may be fitted on the end flange 13 by elastic deformation so that its hooked rims 154 engage with the hooking rims 136 of the attachment tabs 132 on both sides of the end flange 13. The aerodynamic element 15 may also be fitted on the end flange 13 by sliding along the end flange 13.

According to a first variant shown in FIG. 3*a*, there are a single bent portion 153 and a single hooked rim 154.

According to a second variant shown in FIG. 3*b*, the bent portion 153 comprises a stop 155 which in combination with the hooked rim 154 forms a slide 156 into which the hooking rims 136 of the attachment tabs 132 are inserted.

Returning to FIGS. 2*a* and 2*b*, the end flange 13 also includes extensions 134 of the flat body 130. These extensions 134 extend in the same general plane as the flat body 130. At least one extension 134 is arranged between a pair of attachment tabs 130 arranged on the same side of said flat body 130. In the example shown in FIGS. 2*a* and 2*b*, a single extension 134 is arranged between the pairs of attachments 130. It is entirely possible to imagine an embodiment in which there are several extensions 134 between two attachment tabs 130 on the same side of the flat body 130.

These extensions 134 are in particular arranged between the attachment tabs 132 of the pair of attachment tabs 132 such that the width L1 of the flat body 130 between the pair of attachment tabs 132 and an attachment tab 132 arranged on the opposite side of said flat body 130, facing the pair of attachment tabs 132, is less than the width L2 of the flat body 130 at the at least one extension 134. This difference in width makes it possible to increase the general surface area of the flat body 132 and in particular its second surface 130*b*. Thus the useful surface area for attaching the end flange 13 to the heat exchange bundle 3 is enlarged and allows better attachment. This is particularly useful in the context of thin heat exchangers 1 which have a width of between 12 and 18 mm, for example. These extensions 134 preferably have a length such that the total width of the sealing flange 13 does not exceed that of the heat exchanger 1.

The extensions 134 may also in particular be integral with the flat body 130. The extensions 134 may thus be produced by stamping.

The fact that the extensions 134 and the attachment tabs 132 may be integral with the flat body 130 allows the end flange 13 to be produced in one piece, which gives it greater strength. More particularly the extensions 134 and the attachment tabs 132 may be produced by stamping.

FIGS. 2*a* and 2*b* show in particular an end flange 13 according to a first embodiment. In this first embodiment, the attachment tabs 132 on a first side of the flat body 130 are arranged facing the attachment tabs 132 on a second side, opposite to the first side. Likewise, the extensions 134 on the first side of the flat body 130 are arranged facing the extensions 134 on the second side.

FIGS. 4*a* and 4*b* show a variant of the first embodiment of FIGS. 2*a* and 2*b*. In this variant, the attachment tabs 132 on a same side are connected at their top by the hooking rim 136. The extensions 134 are then arranged facing this hooking rim 136 connecting the tops of the attachment tabs 132. This thus makes it possible to increase the surface area for hooking between the end flange 13 and the aerodynamic element 15 and thus to improve the attachment thereof, while still having a second surface 130*b* sufficient for good brazing.

FIGS. 5*a* and 5*b* show an end flange 13 according to a second embodiment. In this second embodiment, the attachment tabs 132 on a first side are arranged facing the extensions 134 on a second side opposite to the first side. Likewise, the extensions 134 on the first side are arranged facing the attachment tabs 132 on the second side.

FIGS. 6*a* and 6*b* show a variant of this second embodiment of FIGS. 5*a* and 5*b*. In this variant, the attachment tabs 132 on a same side are connected at their top by the hooking rim 136. This thus makes it possible to increase the surface area for hooking between the end flange 13 and the aerodynamic element 15 and thus to improve the attachment thereof, while still having a second surface 130*b* sufficient for good brazing.

Thus, it can be clearly seen that by virtue of the structure of the end flange 13 with alternating attachment tabs 132 and extensions 134, the second surface 130*b* is increased, allowing better attachment by brazing of the end flange 13 to the heat exchange bundle 3.

The invention claimed is:

1. A heat exchanger for a motor vehicle, comprising:

a heat exchange bundle comprising a plurality of stacked tubes inside which a first heat-transfer fluid is circulated; and an end flange arranged on each side of the stack of tubes, the end flange being brazed to the heat exchange bundle, the end flanges comprising:

a flat body comprising a first surface configured to face an aerodynamic element and a second surface, referred to as the brazing surface, opposite to the first surface and brazed to the heat exchange bundle, attachment tabs configured to receive the aerodynamic element and arranged on the sides of the flat body, the attachment tabs projecting in the opposite direction to the heat exchange bundle, wherein each of the respective attachment tabs has a hooking rim situated on a top portion configured to interlock with a hooked rim on the aerodynamic element, and at least one extension of the flat body extending in the same plane as the flat body and arranged between a pair of attachment tabs arranged on a same side of the flat body such that the width of the flat body between the pair of attachment tabs is less than the width of the flat body at the at least one extension.

2. The heat exchanger as claimed in claim 1, wherein an extension of the at least one extension is arranged between each pair of attachment tabs arranged along the sides of the flat body.

3. The heat exchanger as claimed in claim 1, wherein the attachment tabs on a first side of the flat body are arranged facing the attachment tabs on a second side opposite to the first side, and that the extensions on the first side of the flat body are arranged facing the extensions on the second side.

4. The heat exchanger as claimed in claim 1, wherein the attachment tabs on a first side are arranged facing the extensions on a second side opposite to the first side, and that the extensions on the first side are arranged facing the attachment tabs on the second side.

5. The heat exchanger as claimed in claim 4, each of the respective attachment tabs situated on a same side are connected at the top by the hooking rim.

6. The heat exchanger as claimed in claim 1, wherein the attachment tabs and the extensions of the flat body are integral with the flat body.

7. The heat exchanger as claimed in claim 6, wherein the attachment tabs and the extensions of the flat body are produced by stamping.

* * * * *